US005743769A

United States Patent [19]

Koguchi

[11] Patent Number: 5,743,769

[45] Date of Patent: Apr. 28, 1998

[54] PRESS-IN CONTACT AND A METHOD FOR MANUFACTURING THE SAME

[75] Inventor: Yasuyuki Koguchi, Tokyo, Japan

[73] Assignee: DDK Ltd., Japan

[21] Appl. No.: 664,999

[22] Filed: Jun. 10, 1996

[30] Foreign Application Priority Data

Aug. 8, 1995 [JP] Japan ..... 7-222482

[51] Int. Cl.[6] ..... H01R 13/42

[52] U.S. Cl. ..... 439/751; 493/943

[58] Field of Search ..... 439/751, 943, 439/405, 395

[56] References Cited

U.S. PATENT DOCUMENTS 4,909,754 3/1990 Paradis ..... 439/751

*Primary Examiner*—Khiem Nguyen
*Assistant Examiner*—Eugene G. Byrd
*Attorney, Agent, or Firm*—Silverman, Cass & Singer, Ltd.

[57] ABSTRACT

A press-in contact includes a connection portion to be connected to a mating connector, a press-fitting portion to be fixed in a cylindrical through-hole of a printed circuit board by press-fitting, and a contact portion for introducing the press-in contact to the printed circuit board. The press-in contact further includes a positioning portion. The positioning portion has two plate-shaped pieces each having a surface to be urged by a jig for press-fitting operation and a connection part for connecting the plate-shaped pieces and the connection portion. The connection portion is formed in a substantially J-shape by bending, and center axes of the connection portion and the positioning portion are shifted from each other. As an alternative, the plate-shaped pieces are formed in a C-shape in cross-section, and center axes of the connection portion and the plate-shaped pieces of the positioning portion are shifted from each other. With this arrangement, the press-in contact can readily be press-fitted into the through-hole of the printed circuit board.

3 Claims, 3 Drawing Sheets

PRESS-IN CONTACT AND A METHOD FOR MANUFACTURING THE SAME

BACKGROUND OF THE INVENTION

This invention relates to a press-in contact adapted to be press-fitted in a through-hole of a printed circuit board to hold the contact relative to the circuit board for mechanical fixation and electrical connection.

Such a contact is disclosed in the U.S. Pat. application Ser. No. 08/499,970, filed Jul. 10, 1995, and entitled "Press-in Contact". The disclosed prior art press-in contact will be explained with reference to FIG. 3 illustrating in a perspective view a press-in contact 30, a jig 34 and a printed circuit board 24 in which the contact 30 has been press-fitted.

The press-in contact 30 has a connection portion 18 for connecting the contact 30 to a mating connector or the like, a positioning portion 32 for axially positioning the contact 30 relative to the printed circuit board 24, a press-fitting portion 20 to be press-fitted in a through-hole 22 of the board 24, and a contact portion 16.

In order that the press-in contact 30 is press-fitted into the printed circuit board 24, surfaces 14 of the positioning portion 32 of the contact 30 are urged by the surface 27 of the jig 34 toward the board 24 in the direction shown by an arrow A in FIG. 3. The jig 34 is formed with through-holes 28 (relief holes) to avoid the interference of the jig 34 with the connection portions 18 of press-in contacts 30. In this case, it is required to provide the through-holes 28 corresponding in number to the press-in contacts 30 to be press-fitted.

As the jig 34 has a number of through-holes 28 as described above, it is very difficult and time-consuming to position the jig 34 to be in alignment with the printed circuit board 34 for press-fitting the press-in contacts 30 into through-holes 22 of the board 24. In other words, the assembling of the press-in contacts on the board is very troublesome and time-consuming.

In addition, severe requirements are imposed on the positional accuracy between the press-in contacts 30 and the through-holes 28 of the jig 34 so that the jig 34 can be worked with a great difficulty, and because of its great many through-holes 28 the working of the jig 34 is also time consuming.

Moreover, if the through-holes 28 of the jig 34 are too small, even slight deviations in pitches between the through-holes 28 may often damage the connection portions 18 of the press-in contacts 30. On the other hand, too large through-hole 28 will make it impossible to push the surfaces 14 of the positioning portions 32 of the press-in contacts 30 so that they could not be press-fitted into the through-holes 22 of the circuit board 24. For the purpose of press-fitting, therefore, it will be needed to enlarge the positioning portions 32 of the contacts 30 and hence to enlarge their pitches.

SUMMARY OF THE INVENTION

It is an object of the invention to provide an improved press-in contact which overcomes the various disadvantages of the prior art press-in contact described above.

In order to achieve the above object, in a press-in contact composed of a connection portion to be connected to a mating connector, a press-fitting portion to be fixed in a cylindrical through-hole of a printed circuit board by press-fitting, and a contact portion for introducing the press-in contact into the through-hole of said printed circuit board, according to the invention said press-in contact further comprises a positioning portion which comprises two plate-shaped pieces each having a surface to be urged by a jig for press-fitting operation and a connection part for connecting said plate-shaped pieces to said connection portion, said connection portion being formed in a substantially J-shape, and center axes of said connection portion and said positioning portion being shifted from each other.

In another aspect of the invention, the positioning portion of the press-in contact comprises two plate-shaped pieces each having a surface to be urged by a jig for press-fitting operation and a connection part for connecting said plate-shaped pieces to said connection portion, said plate-shaped pieces being formed in a C-shape, and center axes of said connection portion and said plate-shaped pieces of the positioning portion being shifted from each other.

In a further aspect of the invention, a method for producing a press-in contact comprises steps of punching a metal sheet to form a flat-shaped press-in contact blank having an integral extra metal sheet, drawing the press-fitting portion of the punched contact blank into a substantially V-shape in cross-section, further drawing the substantially V-shaped cross-sectional press-fitting portion to form its inside into a U-shape in cross-section and its outside into a shape having plural arc parts and a straight line, partially cutting the contact blank to form plate-shaped pieces and a connection portion, working said connection portion by bending into a substantially J-shape, and finally removing the press-in contact from said extra metal sheet.

As the center axes of the connection portion and the plate-shaped pieces of the positioning portion of the press-in contact are shifted from each other, there is no need to provide the through-holes in the jig. The press-in contacts can be easily press-fitted into the through-holes of the printed circuit board without requiring any positioning of center axes of the press-in contacts in the plate-shaped jig.

As there is no need to provide the through-holes or relief holes, the jig for press-fitting is simple in construction and easy to produce. The press-in contacts can be simply press-fitted into the through-holes of the circuit board without difficult positioning so that assembling of the contacts in the circuit board is easily effected. As the center axes of the connection portion and the plate-shaped pieces of the positioning portion of the press-in contact are shifted from each other, there is no longer any risk of the connection portion of the contact being damaged by the jig.

The invention will be more fully understood by referring to the following detailed description and claims taken in connection with the appended drawings.

DESCRIPTION OF THE PREFERRED EMBODIMENT

Figure 1:
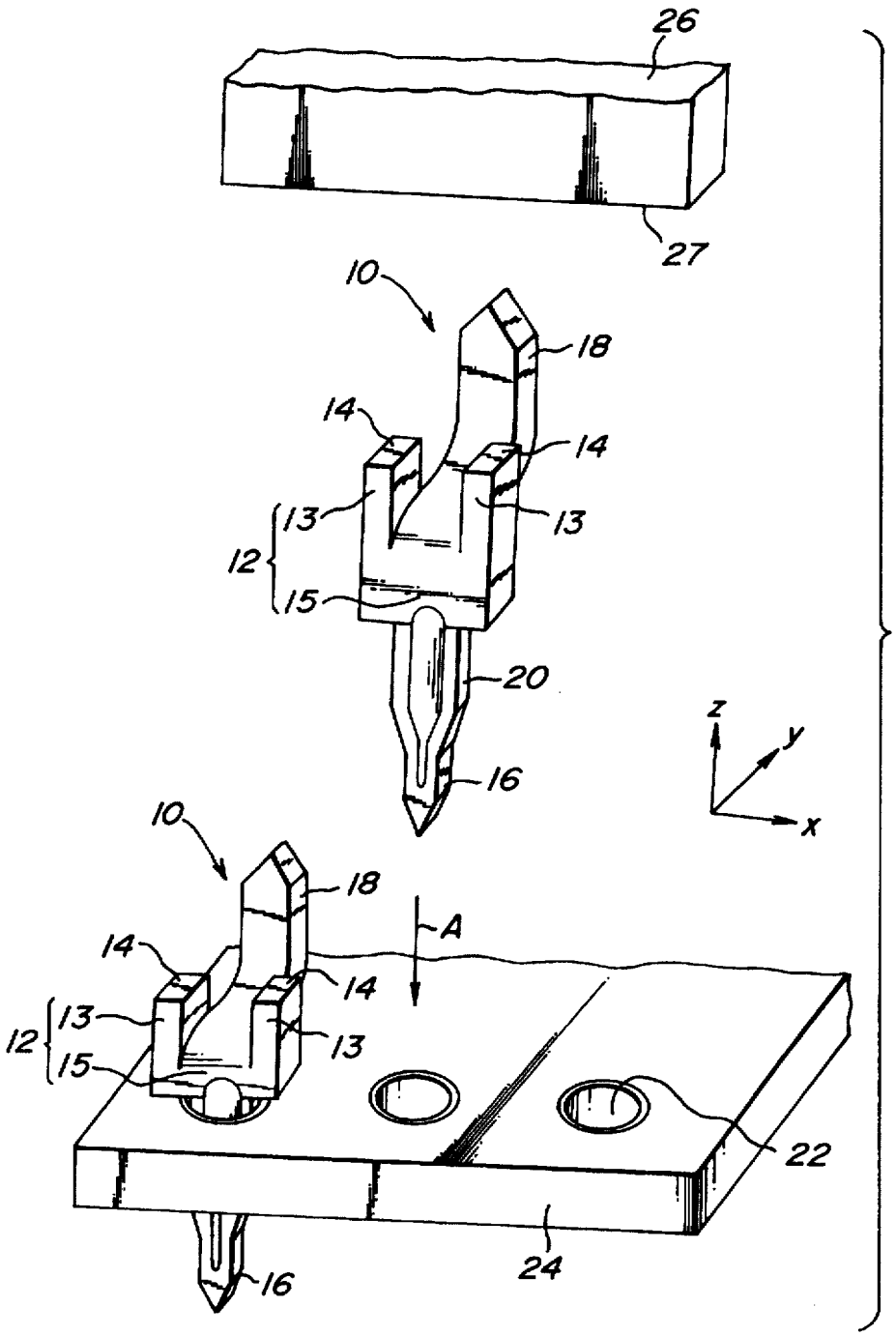
FIG. 1 is a perspective view illustrating a jig, a press-in contact according to the invention and a printed circuit board having the press-in contact press-fitted therein.

One embodiment of the present invention will be explained with reference to FIG. 1 illustrating in a perspective view a jig 26, a press-in contact 10 and a printed circuit board 24 having through-holes 22 in the state that the press-in contact 10 has been press-fitted in one of the holes 22. Preferred materials of the press-in contact 10 generally include phosphor bronze, beryllium copper and the like because it is required to have a springiness for being press-fitted into the through-hole of a printed circuit board 24.

A press-in contact generally consists of a connection portion 18, a press-fitting portion 20 and a contact portion 16, these portions being provided normally in this order. In contrast herewith, the press-in contact according to the invention is further provided with a positioning portion 12 located between the connection portion 18 and press-fitting portion 20.

In the shown embodiment, the press-in contact 10 has a width of the order Of 2.0 mm, a length of 12 mm and a thickness of 0.5 mm.

The construction, role and the like of respective portions of the press-in contact 10 according to the invention will be explained hereinafter.

The connection portion 18 serves to connect the press-in contact 10 to a mating connector, an electric cable, a circuit of a board (not shown) or the like. In this shown embodiment, the connection portion 18 is substantially in the form of a prism having a cross-section of 0.5 mm×0.6 mm and a length of the order of 2.0 mm.

Then, the contact portion 16 serves also as a guide for introducing the press-in contact 10 into one through-hole 22 of the printed circuit board 24. For this purpose, the contact portion 16 is often formed longer and finished by lapping in order to ensure its smooth introduction into the through-hole 22. The contact portion 16 electrically contacts the contact portion of a contact of a mating connector (not shown) when the contact portion 16 is fitted with the mating connector after the press-in contact 10 has been press-fitted in the through-hole 22 of the printed circuit board 24.

The contact portion 16 in the shown embodiment has a particular cross-section obtained by cutting a circle by two parallel straight lines, that is to say, the cross-section having four sides of which opposite two sides are straight lines and the remaining opposite sides are arcs. However, other cross-section may be used, for example, a circular or rectangular cross-section. The contact portion 16 has a width of the order of 0.6 mm, a thickness of 0.5 mm and a length of 2.0 mm.

The press-fitting portion 20 is adapted to be press-fitted in the through-hole 22 of the printed circuit board 24. This portion 20 may have any shape so long as it can be press-fitted in the hole 22 to obtain a force sufficient to hold the press-in contact 10 in the board 24 without any breaking of the circuit board 24.

The press-fitting portion 20 of the press-in contact 10 in the shown embodiment has a substantially U-shaped cross-section whose inner periphery forms a U-shaped groove and outer periphery consists of two arc parts and a straight part therebetween. These arc parts exert compression forces on the inside of the through-hole 22 of the printed circuit board 24 to hold the press-in contact 10 therein when it has been press-fitted in the board 24.

The circular arc of the inner periphery and the arc parts of the outer periphery of the press-fitting portion 20 are in a relation of eccentric circles whose centers are shifted from each other by a slight value of the order of 0.07 to 0.1 mm in the direction of y axis (x, y, z coordinates in FIG. 1). The outer periphery of the press-fitting portion 20 is also eccentric to the through-hole 22 before press-fitting. However, the arc parts of the outer periphery are concentric to the through-hole 22 after the press-in contact has been press-fitted in the hole.

The thickness of the press-fitting portion 20 is progressively thinner toward the open end of the U-shaped section. The press-fitting portion 20 has a width of the order of 0.65 mm, a thickness of 0.49 mm and a length of 3.6 mm. The width depends upon the diameter of the through-hole 24, while the length depends upon the thickness of the print circuit board 24. In the shown embodiment, the thickness of the press-fitting portion 20 is 0.17 to 0.21 mm the bottom of the U-shaped section, 0.1 to 0.14 mm at the middle portion and 0.03 to 0.08 mm at the open end.

The printed circuit board 24 is of the order of 2.4 mm in thickness and its through-holes are 0.6 mm in diameter. These values depend upon applications to be used. As the dimensions of the press-fitting portion 20 of the press-in contact 10 depend upon the thickness and through-hole diameter of the printed circuit board 24, the press-fitting portion 20 may be suitably designed in dimension each time. Moreover, the press-fitting interference (difference between the diameters of the through-hole and press-fitting portion in relaxed state), the length of the arc parts and the position of the straight part to be cut will vary according to required holding force so that these values may be suitably selected on the basis of the general pin-contact design standard.

The positioning portion 12 of the press-in contact 10 which is the subject feature of the invention will be explained hereinafter.

The positioning portion 12 comprises two plate-shaped pieces 13 and a connection part 15 for connecting the connection portion 18 to the two plate-shaped pieces 13. Each of the plate-shaped pieces 13 has a surface 14 adapted to abut against a plate-shaped jig 26 for inserting the contact 10 into the through-hole 22 of the printed circuit board 24 as shown in FIG. 1 and further a surface abutting against the surface of the printed circuit board 24 after the contact 10 has been press-fitted in the through-hole 22.

The positioning portion 12 has a width of the order of 0.4 mm, a thickness of 0.5 mm and a length of 2.0 mm.

The connection portion 18 is curved away from the plate-shaped pieces 13 in the direction y substantially into the form of "J" in order to prevent the connection portion 18 from contacting the jig 26 when the press-in contact 10 is being press-fitted into the printed circuit board 24 by the use of the jig 26. In other words, the center of the connection portion 18 is shifted from centers of the contact portion 16 and the positioning portion 12. In the shown embodiment, the shifting of the center of the connection portion 18 is of the order of 1.0 mm. The shifted value has no limitation so long as the the connection portion 18 does not interfere with the jig 26, but the value is preferably as small as possible in consideration of the size of the connector (or pitch of contacts) and it is generally suitably determined to meet the thickness of the jig 26.

In the shown embodiment, the plate-shaped pieces 13 have a width of the order of 0.4 mm, a thickness of 0.5 mm and a height of 2.0 mm.

As shown in FIG. 1, the press-in contact 10 is moved in the direction shown by an arrow A to be press-fitted into the through-hole 22 of the printed circuit board 24. In inserting, the press-in contact 10 is urged by the jig 26 with its surface 27 in abutment against the surfaces 14 of the plate-shaped pieces 13 of the press-in contact 10 so that the press-fitting portion 20 is press-fitted into the through-hole 22 of the printed circuit board 24.

The ends at the opening end of the U-shaped cross-sectional press-fitting portion 20 may be bent inwardly or rounded at its outer periphery in order to avoid the printed circuit board 24 from being scratched in press-fitting the press-in contact 10 into the through-hole 22 of the printed circuit board 24.

Figure 2:
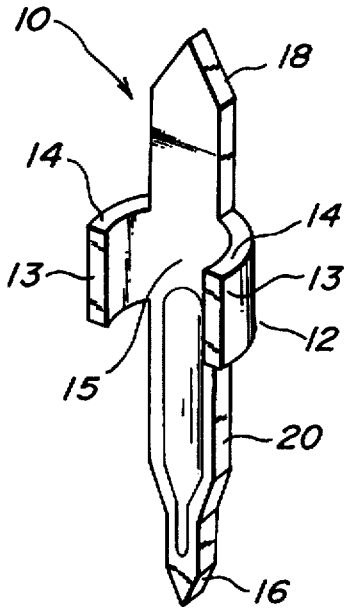
FIG. 2 is a perspective view of a modified press-in contact according to the invention.
Figure 3:
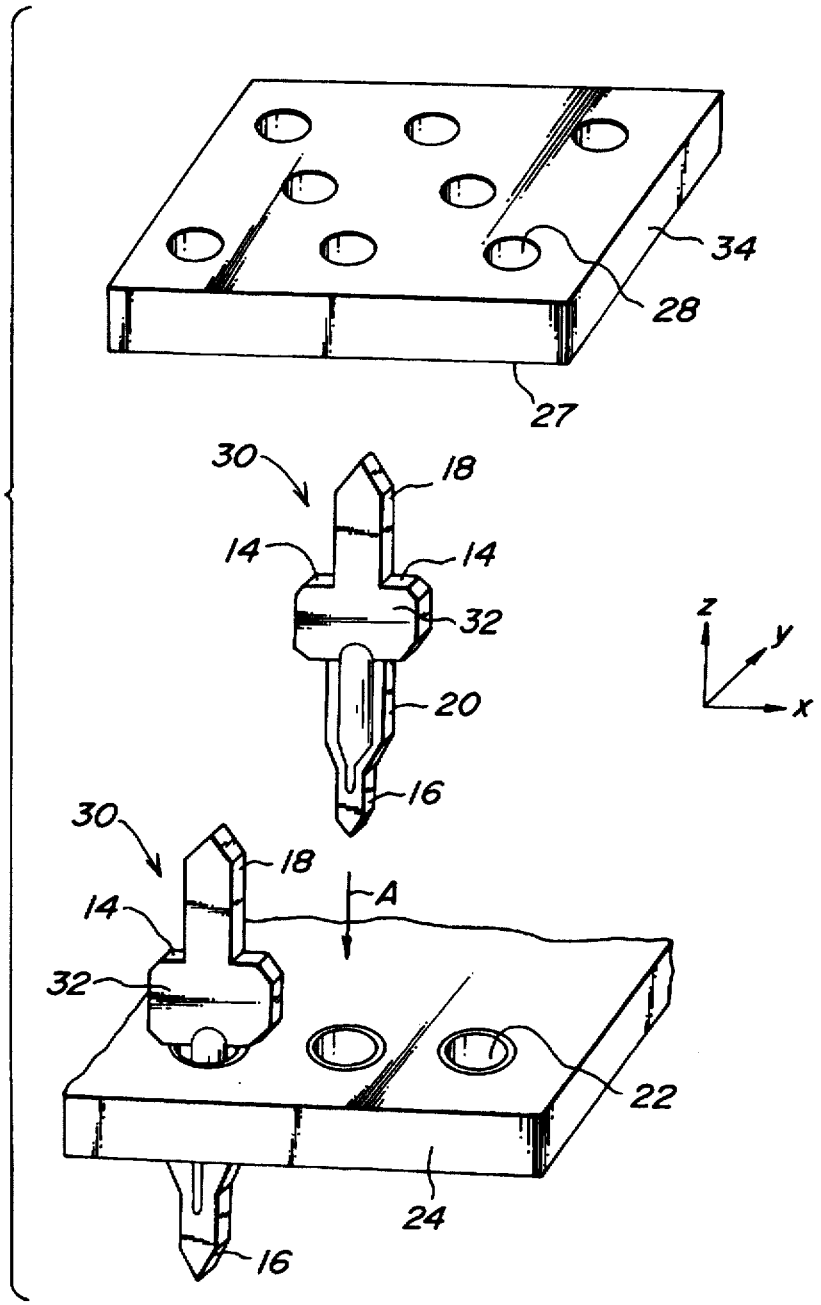
FIG 3 PRIOR ART
FIG. 3 is a perspective view illustrating a jig, a press-in contact of the prior art and a printed circuit board having the prior art press-in contact press-fitted in a through-hole of the circuit board.

A modification of the press-in contact according to the invention will be explained hereinafter by referring to FIG. 2.

In this embodiment, the press-in contact 10 comprises a positioning portion 12 having plate-shaped pieces 13 which are curved in the form of "C". Centers of the connection portion 18 and the contact portion 16 are aligned with each other different from those in the embodiment shown in FIG. 1. However, the plate-shaped pieces 13 of the positioning portion 12 are shifted from the centers of the contact portion 16 and connection portion 18.

In this case, likewise, the shifting between the centers of the connection portion 18 and plate-shaped pieces 13 prevents any interference of the connection portion 18 with the jig 26 when the press-in contact 10 is being press-fitted into the printed circuit board 24. The press-in contact 10 is press-fitted in the printed circuit board 24 by urging the surfaces of the plate-shaped pieces 14 by means of the jig 26 in the same manner as in FIG. 1.

The press-in contact 10 according to the invention may be produced by the known sheet metal working. However, the sheet metal working is not exclusive, and casting and mechanical cutting may be used so long as the above described dimensional accuracy and performance of the produced contacts are obtained.

A typical method for producing the press-in contact according to the invention as shown in FIG. 1 using press working will be explained hereinafter.

First a metal sheet is punched to form a flat-shaped contact blank having an integral extra metal sheet portion. Second the press-fitting portion of the punched contact blank is subjected to a first drawing into a substantially V-shape in cross-section. Thereafter, the drawn press-fitting portion is further subjected to a second drawing so as to form its inside into a U-shape in cross-section and its outside into a shape having plural arc parts and a straight line in cross-section. Further, the contact blank is partially cut to form plate-shaped pieces 13 and a connection portion 18 which is then worked by bending into "J" shape. Finally, the thus formed press-in contact is removed from the extra metal sheet portion by cutting to obtain a complete press-in contact.

While the invention has been particularly shown and described with reference to preferred embodiments thereof, it will be understood by those skilled in the art that the foregoing and other changes in form and details can be make therein without departing from the spirit and scope of the invention.

What is claimed is:

1. A press-in contact comprising, a connection portion to be connected to a mating connector, a press-fitting portion to be fixed in a cylindrical through-hole of a printed circuit board by a press-fitting operation, and a contact portion for introducing the press-in contact into the through-hole of said printed circuit board, said press-in contact including a positioning portion with two plate-shaped pieces each having a surface to be urged by a jig for said press-fitting operation and a connection part for connecting said plate-shaped pieces to said connection portion, said connection portion being formed in a substantially J-shape, the center axes of said connection portion and said positioning portion being shifted from each other to prevent the connection portion from contacting the jig during said press-fitting operation.

2. A press-in contact comprising, a connection portion to be connected to a mating connector, a press-fitting portion to be fixed in a cylindrical through-hole of a printed circuit board by a press-fitting operation, and a contact portion for introducing the press-in contact into the through-hole of said printed circuit board, said press-in contact including a positioning portion with two plate-shaped pieces each having a surface to be urged by a jig for said press-fitting operation and a connection part for connecting said plate-shaped pieces to said connection portion, said plate-shaped pieces being formed in a C-shape, the center axes of said connection portion and said plate-shaped pieces of the positioning portion being shifted from each other to prevent the connection portion from contacting the jig during said press-fitting operation.

3. The press-in contact as set forth in claim 1 or 2, wherein the center axes of said connecting portion and said plate-shaped pieces of the positioning portion are shifted from each other by 0.5 mm to 1.0 mm.

* * * * *